US005351069A

United States Patent [19]

Koike et al.

[11] Patent Number: 5,351,069

[45] Date of Patent: Sep. 27, 1994

[54] SUBLIMATION TYPE THERMAL TRANSFER PRINTER AND INK SHEET USED WITH THE SAME

[75] Inventors: Kiyoshi Koike; Jyunichi Aizawa; Hiroshi Nakao; Kunihiko Nakagawa, all of Nagaokakyo, Japan

[73] Assignee: Mitsubishi Denki Kabushiki Kaisha, Tokyo, Japan

[21] Appl. No.: 983,235

[22] Filed: Nov. 30, 1992

[30] Foreign Application Priority Data

Jan. 27, 1992 [JP] Japan ..... 4-012003
Jan. 28, 1992 [JP] Japan ..... 4-012875

[51] Int. Cl.[5] ..... B41J 2/325

[52] U.S. Cl. ..... 366/76 PH; 400/240; 400/240.4

[58] Field of Search ..... 346/76 PH; 400/120, 400/611, 612, 617, 240, 240.4

[56] References Cited

U.S. PATENT DOCUMENTS 5,006,502 4/1991 Fujimura et al. ..... 503/227

FOREIGN PATENT DOCUMENTS 58-148779 9/1983 Japan .
63-91281 4/1988 Japan .
290465 11/1990 Japan .

*Primary Examiner*—Benjamin R. Fuller
*Assistant Examiner*—Huan Tran

[57] ABSTRACT

A sublime type thermal transfer printer uses an ink sheet on which a fixing agent of a sublimation ink is coated and thermally transfers the fixing agent of the ink sheet onto a plain printing paper first, then thermally transfers an image on the ink sheet onto the area of the printing paper where the fixing agent is transferred by subliming an ink coated on the ink sheet.

21 Claims, 30 Drawing Sheets

SUBLIMATION TYPE THERMAL TRANSFER PRINTER AND INK SHEET USED WITH THE SAME

BACKGROUND OF THE INVENTION

1. Field of the Invention

The present invention relates to a sublimation type thermal transfer printer in which images are thermally transferred to a sheet of paper by pressing a thermal head onto the back of an ink sheet to sublime the ink, and to an ink sheet used with the printer.

2. Description of the Related Art

FIG. 1 is a side view of a sublimation type thermal transfer printer disclosed in Japanese Patent Application Laid Open No. 63-91281(1988). In the figure, the reference numeral 1 designates a thermal head that is rotated about support at one end. At the tip of the thermal head 1 is mounted an ink sheet separation roller 1*a*. A platen 2, a cylindrical rubber roller, is disposed at a position opposite to the heating elements of the thermal head 1. The platen 2 has a clamper 12 which clamps a printing paper 3 and presses the printing paper 3 onto the surface of the platen 2. The printing paper 3 is special for sublimation thermal transfer printing and coated with a plastic image-receiving layer for fixing the sublimation ink on the surface thereof. A pair of transport rollers 11 are disposed in the upstream of the platen 2, which delivers the printing paper 3 to the platen 2 or discharges the printing paper 3 outside the printer. The printing paper 3 is pressed and held onto the platen 2 by the clamper 12 and is transported to the transfer position or the discharge position as the platen 2 is rotated. An ink sheet 4 wound around a takeup reel 5*a* and a supply reel 5*b* runs between the thermal head 1 and the platen 2 in the direction shown by an arrow. In the vicinity of the tip of the thermal head 1 are disposed photosensors 9 for detecting a start mark on the ink sheet 4.

FIG. 2 is a side view of a printer disclosed in Japanese Patent Application Laid Open No. 1-290465(1989), which is similar to the one described above. The same or corresponding parts to those in FIG. 1 are designated by the same reference numerals, and explanation of such parts is omitted herein.

In the prior art of FIG. 2, the ink sheet 4 and the takeup and supply reels 5*a* and 5*b* are encased in a cassette 6, and the clamper 12 in FIG. 1 is replaced by a driving capstan roller 7 and a pinch roller 8 driven by the capstan roller 7, which transport the printing paper 3 to the transfer position or the discharge position. The printing paper 3 is pressed between the capstan roller 7 and the pinch roller 8 and discharged outside the printer. There are also provided a pair of photosensors 9 and 9 spaced apart in the crosswise direction of the ink sheet 4 in the vicinity of the tip of the thermal head 1. In FIG. 2, reference character A indicates the direction in which the printing paper 3 is transported during printing.

FIG. 3 is a plan view of the conventional ink sheet 4. Areas on a base film of the ink sheet 4 are sequentially coated with sublimation inks of yellow, magenta, and cyan in this order, in equal length shorter then the length of the transfer area of the printing paper 3. A start mark 4*a* coated with a black ink is interposed between the cyan and yellow areas on the ink sheet.

FIG. 4 is a plan view of another conventional ink sheet 4. The ink sheet 4 contains marks 4*b*, 4*c* and 4*d* respectively indicating the start of the yellow area, the magenta area and the cyan area, which are disposed at the beginning of the respective color area and each mark is coated with a black ink in different part from the other.

The operation of the first conventional printer using the ink sheet 4 of FIG. 3 will now be described. FIGS. 5, 6, and 7 are side views showing the printer in paper feeding, transfer printing, and paper discharging, respectively.

As shown in FIG. 5, the platen 2 is rotated to move the clamper 12 closer to the transport rollers 11 and 11 to position the clamper 12 at the paper feed position, then the clamper 12 is raised from the surface of the platen 2. Next, the transport rollers 11 and 11 are rotated in arrow directions as shown, to deliver the printing paper 3 to the clamper 12. When the leading edge of the printing paper 3 reaches the clamper 12, the clamper 12 is lowered to the surface of the platen 2 to firmly press and hold the leading edge of the printing paper 3 onto the platen 2. As the platen 2 is rotated, the printing paper 3 is wound around the surface of the platen 2 and is placed at the transfer position. At the same time, the takeup reel 5*a* reels up the ink sheet 4 until the photosensor 9 detects the start mark 4*a* on the ink sheet 4, thus readying the ink sheet 4 for printing.

Then, as shown in FIG. 6, the thermal head 1 is turned to press the ink sheet 4 onto the printing paper 3 held on the surface of the platen 2. When rotating the platen 2 in the arrow direction, the thermal head 1 is energized to sublime each color ink on the ink sheet 4 and transfer each color image to the printing paper 3. After the yellow ink is transferred, the magenta and cyan inks are transferred, in this order, to the same transfer area on the printing paper 3 which is moved back to the start position of the yellow ink transfer. When the clamper 12 passes beneath the thermal head 1, the thermal head 1 is temporarily turned upward to avoid contact with the clamper 12.

Since the length of each color area on the ink sheet 4 is shorter than the transfer area on the printing paper 3, each color ink is transferred a plurality of times for one transfer area by changing the transfer start position each time. The three color inks, yellow, magenta and cyan are thus successively transferred one on another to produce a full color print.

After the transfer process is completed, the thermal head 1 is turned upward, as shown in FIG. 7, and the platen 2 is rotated in the arrow direction as shown. The trailing edge of the printing paper 3 is then transported backward by the transport rollers 11 and 11 which are now rotating in the directions opposite to those in the paper feeding operation. Upon reaching the paper feed position, the clamper 12 releases the printing paper 3 which is then discharged from the printer only by the rotation of the transport rollers 11 and 11.

Next, the operation of the second conventional printer which uses the ink sheet 4 of FIG. 4 will be described below. FIGS. 2 and 8 show the printer in paper feeding and transfer printing, respectively, and FIG. 9 shows the printer in color change or paper discharge operations. In FIG. 9, the reference character B indicates the direction in which the printing paper 3 is moved backward when changing the ink color to be transferred.

With the thermal head 1 resting in standby position above the platen 2, as shown in FIG. 2, the printing paper 3 is delivered to the print start position as in the figure. The takeup reel 5*a* is rotated to reel up the ink sheet 4 until the mark 4*b* indicating the start of the yellow ink area on the ink sheet 4 is detected by the photosensors 9, thus readying the ink sheet 4 for printing.

Then, as shown in FIG. 8, the thermal head 1 presses the ink sheet 4 and the printing paper 3 onto the platen 2. The capstan roller 7 and the pinch roller 8 catch and press the printing paper 3 between and the pinch roller 8 follows the rotation of the capstan roller 7 thereby to transport the printing paper 3 in the arrow direction A. At the same time, the takeup reel 5*a* reels up and transports the ink sheet 4.

As the printing paper 3 is moved, prescribed electrical signals are applied to the thermal head 1 to selectively heat the heating elements in the thermal head 1. The heat is conducted to the ink sheet 4 so that the yellow ink is sublimed and fixed to the image receiving layer on the surface of the printing paper 3. When the yellow ink printing for one picture is completed, the thermal head 1 is moved apart from the platen 2 and is lifted upward as shown by dotted lines in FIG. 9.

The takeup reel 5*a* reels up to transport the ink sheet 4 until the mark 4*c* indicating the beginning of the magenta ink area on the ink sheet 4 is detected by the photosensors 9. The capstan roller 7 now is rotated in the opposite direction to the paper feed direction for printing, to move the printing paper 3 backward in the direction B. The capstan roller 7 is stopped to rotate when the printing paper 3 is positioned at the start position of printing as shown in FIG. 2.

Next, printing with magenta ink is performed in the same manner as the yellow ink printing. After that, as the start of the magenta ink printing, the printing paper 3 is moved backward to the print start position for printing with cyan ink. In this manner, the three color inks of yellow, magenta and cyan are sublimed and thermally transferred one on another to produce a full color image on the printing paper 3.

At the end of the transfer printing process, the takeup reel 5*a* is slightly rotated to move the ink sheet 4 by a small distance in order to take in the slack of the ink sheet 4 caused by the upward movement of the thermal head 1. Next, the capstan roller 7 is rotated in the same direction as in the transfer printing, to further transport the printing paper 3 in the direction A, thus discharging it outside the printer.

As described, the conventional sublimation type thermal transfer printer of the above construction requires the use of special printing paper consisting of a plastic image-receiving layer for fixing sublimation ink coated on a base film, and cannot use plain paper as in plain paper copiers. Therefore, the printing cost of color images is high.

On the other hand, a sublimation type thermal transfer printer capable of color printing on plain paper requires special control circuitry and control software for controlling the printer, which complicates the mechanism, increases the size of the printer, and requires a longer time to print out a color image.

Furthermore, with such printers, print quality is lower and less stable than the sublimation type thermal transfer printer that uses special treated paper precoated with an image receiving layer. Moreover, when using various kinds of printing paper, such as plain paper and special treated paper, of different thicknesses and surface friction coefficients, it is difficult, in such printers, to precisely control the transportation of every different kind of printing paper.

SUMMARY OF THE INVENTION

In view of the above enumerated problems, it is a primary object of the present invention to provide a sublimation type thermal transfer printer, along with an ink sheet used for the printer, which permits color printing on plain paper and ensures production of color images of high quality, and which can precisely control the transportation of various kinds of printing paper of different thicknesses and surface friction coefficients, without using special control hardware and software.

The above and further objects and features of the invention will more fully be appreciated from the following detailed description with accompanying drawings.

DESCRIPTION OF THE PREFERRED EMBODIMENTS

The sublimation type thermal transfer printer of the invention and an ink sheet used with the printer will now be described below with reference to the accompanying drawings.

Figure 1:
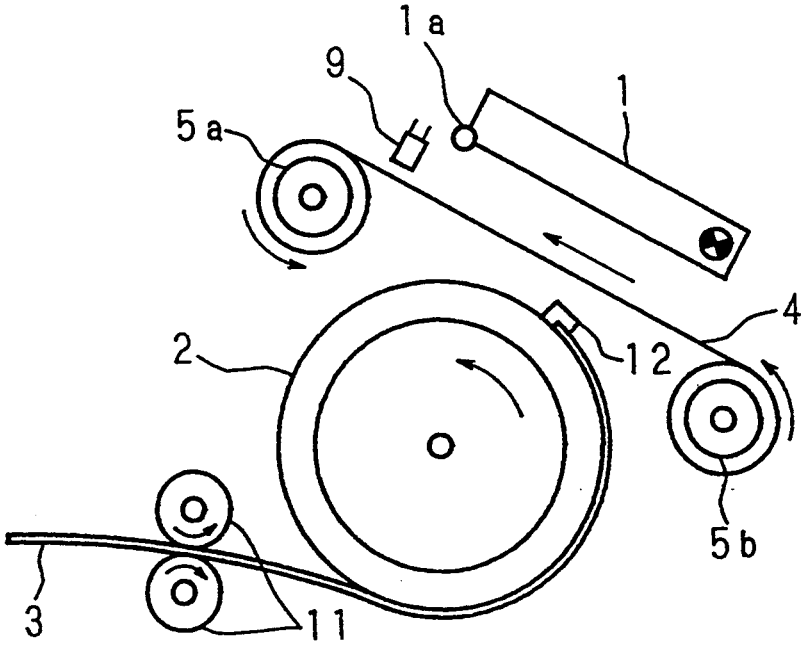
FIG. 1 PRIOR ART
FIG. 1 is a side view of a conventional sublimation type thermal transfer printer.
Figure 10:
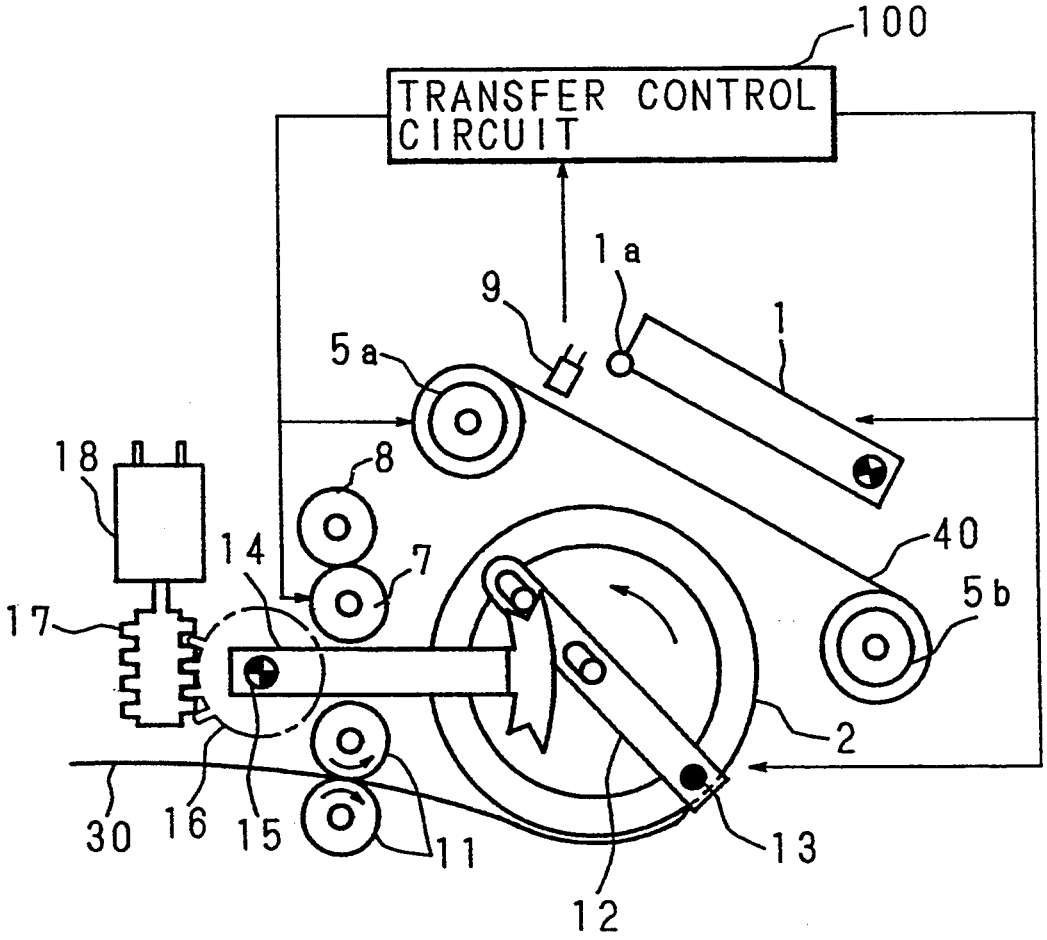
FIG. 10 is a side view of a sublimation type thermal transfer printer according to one embodiment of the present invention.

FIG. 10 is a side view showing one embodiment of the sublimation type thermal transfer printer of the invention. The same or corresponding parts to those in the conventional printer of FIG. 1 are designated by the same reference numerals, and explanatory description of such parts is omitted herein.

Printing paper 30 is plain paper such as PPC paper used in copiers, etc. In FIG. 10, a reference numeral 7 designates a capstan roller, the driving roller, and a numeral 8 indicates a pinch roller 8 which is driven by the capstan roller 7. The capstan roller 7 and the pinch roller 8 are disposed on the discharge side of the printing paper 30 and act as transport rollers to transport the printing paper 30 pressed between them and discharge it outside the printer. In this embodiment, therefore, the transport rollers 11 and 11 act only as paper feed rollers. In the figure, numerals 13–18 designate the following parts, respectively; 13 a clamper pin protruding from one side of a clamper 12 in the axial direction of a platen 2; 14 an arm having a V-shaped groove on each tip, the grooves being open in the opposite direction to each other, which is rotatable around the axis of rotation 15; 16 a worm wheel fixed to the axis of rotation 15; 17 a worm; 18 a motor.

There is also provided a transfer control circuit 100 which is responsible for various control operations including the control of the transfer speed through adjustment of the rotational speeds of the takeup reel 5*a* and the capstan roller 7, the control of the heating cycle and the number of times of heating of the thermal head 1, the control of the force used to press the thermal head 1 onto the platen 2, and the control of the number of times of the printing paper 30(3) being moved backward in the reverse feeding direction B.

Figure 11:
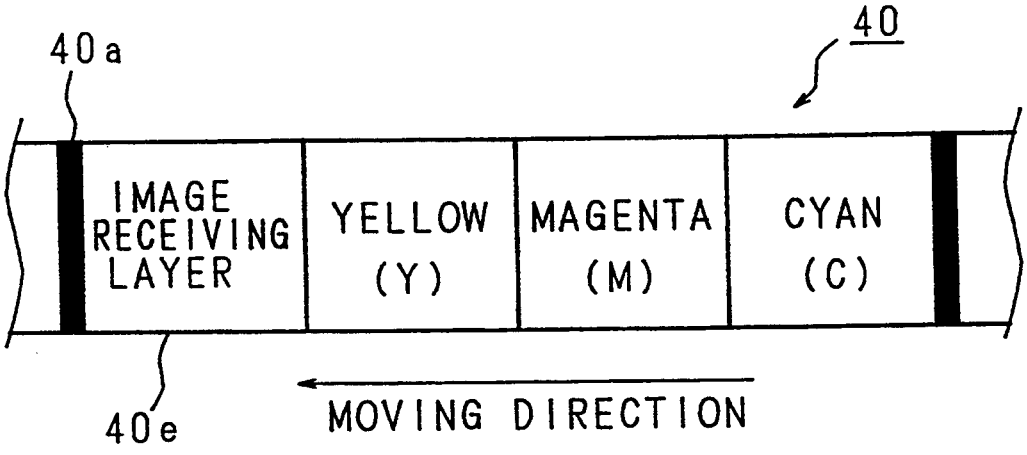
FIG. 11 is a plan view of an ink sheet according to one embodiment of the invention.

FIG. 11 is a plan view of an ink sheet 40 according to one embodiment of the invention. On a base film of the ink sheet 40 is formed an image receive coating area 40*e* coated with a fixing agent of a sublimation ink, followed by yellow, magenta, and cyan sublimation ink coated areas. Prior to printing, the fixing agent of the image receive coating area 40*e* is first transferred to the printing paper 30 to form thereon an image receiving layer for fixing the subsequently transferred sublimation inks. A start mark 40*a* is provided between the cyan ink area and the image receive coating area 40*e*.

Figure 12:
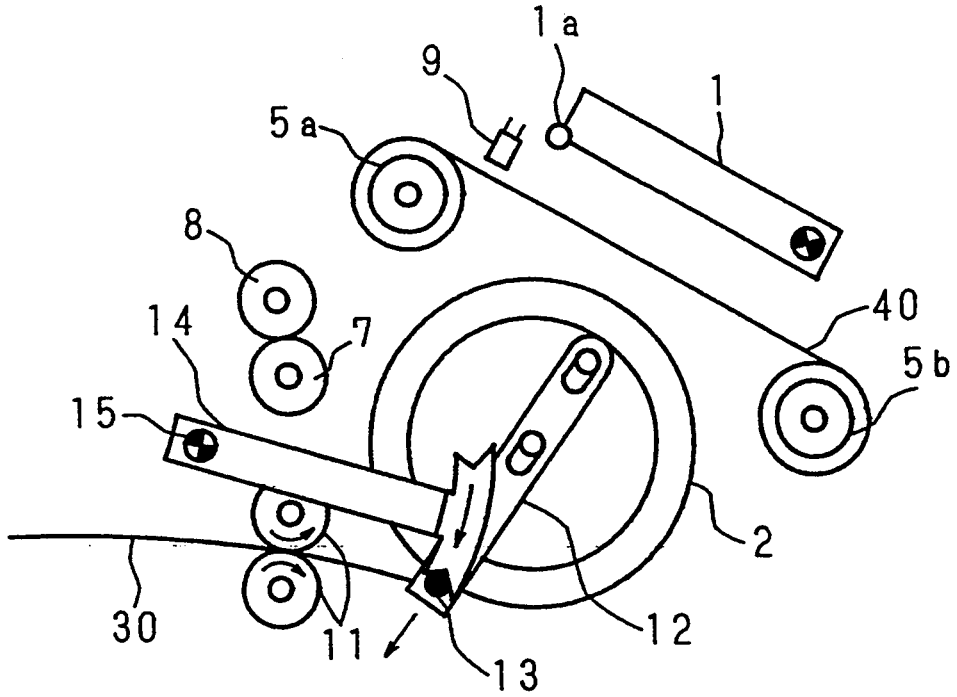
FIG. 12 is a side view showing the printer of FIG. 10 in paper feeding.
Figure 13:
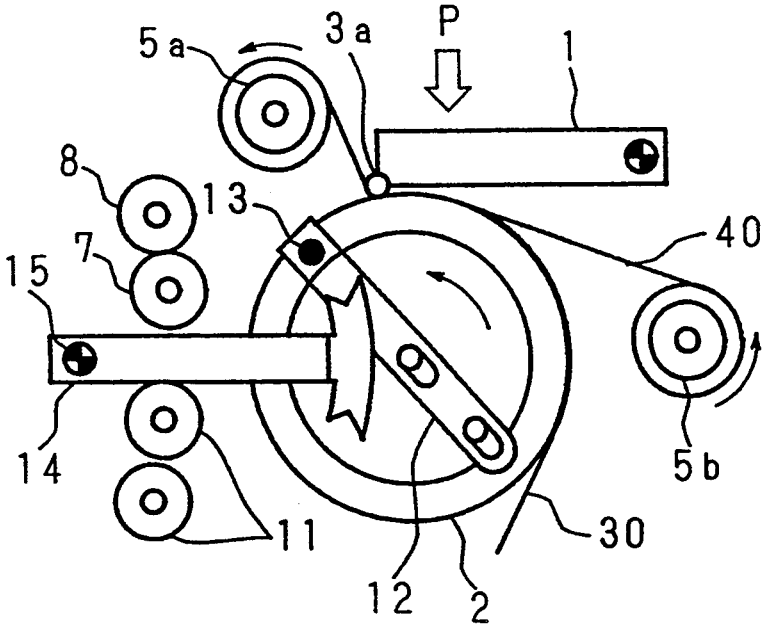
FIG. 13 is a side view showing the printer of FIG. 10 in transfer printing.
Figure 14:
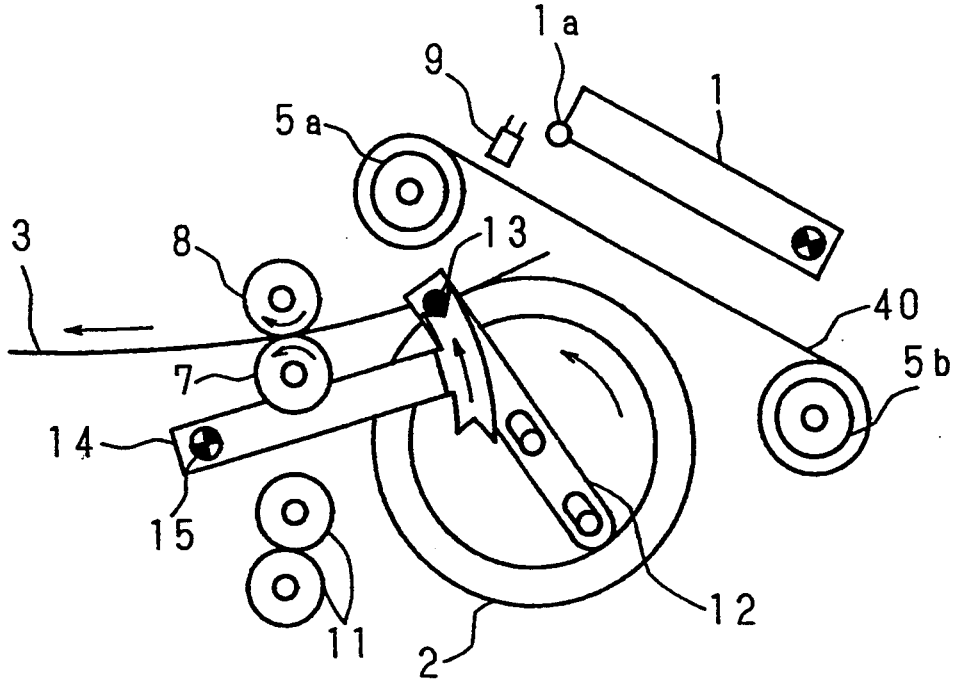
FIG. 14 is a side view showing the printer of FIG. 10 in paper discharging.

Next, we will describe the sublimation type thermal transfer printer of the invention in operation for color printing on plain paper by using the ink sheet 40 of the invention. FIGS. 12, 13, and 14 are side views respectively showing the printer in paper feeding, transfer printing, and paper discharging.

First, the platen 2 is rotated to move the clamper 12 to the paper feed position shown in FIG. 12. Then, the arm 14 is turned around the axis of rotation 15 in the arrow direction shown in FIG. 12 by means of the driving mechanism consisting of the worm wheel 16, worm 17 and motor 18 shown in FIG. 10. The V-shaped groove at the end of the arm 14 engages the clamper pin 13 to raise the clamper 12 from the surface of the platen 2. When the leading edge of the printing paper 30 transported by the transport rollers 11 and 11 is inserted between the clamper 12 and the platen 2, the arm 14 is turned in the direction opposite to the arrow direction shown in FIG. 12, causing the clamper 12 to lower toward the surface of the platen 2. The printing paper 30 is now held and pressed onto the platen 2 and is wound around the surface thereof as the platen 2 is rotated. At the same time, the takeup reel 5*a* reels up and moves the ink sheet 40 until the photosensors 9, 9 detect the start mark 40*a* on the ink sheet 40 to position the ink sheet 40 at the print start position.

When being ready for printing, the thermal head 1 is turned toward the platen 2, as shown in FIG. 13, to press the ink sheet 40 onto the printing paper 30 wound on the platen 2. Next, while the platen 2 is being rotated in the arrow direction shown in FIG. 13, the thermal head 1 is energized first to transfer the fixing agent on the image receive coating area 40*e* of the ink sheet 40 to the printing paper 30. Then, the printing paper 30 with the fixing agent transferred thereon is moved backward to the transfer position for transfer of each color ink. The three color inks of yellow, magenta and cyan are thus transferred successively one on another onto the printing paper 30 to perform a full color printing. When the clamper 12 moves beneath the thermal head 1 during the backward feeding of the printing paper 30, the thermal head 1 is temporarily moved upward to avoid contact with the clamper 12.

When the transfer process is completed, the thermal head 1 is turned upward, as shown in FIG. 14, and the platen 2 is rotated in the arrow direction to move the clamper 12 to the paper discharge position. The arm 14 is turned around the axis of rotation 15 in the arrow direction shown in FIG. 14 by means of the driving mechanism not shown. This causes the V-shaped groove at the end of the arm 14 to engage the clamper pin 13 to raise the clamper 12 from the surface of the platen 2 and thereby release the printing paper 30. In this process, the thermal head 1 is temporarily lowered to press the printing paper 30 onto the platen 2, and the platen 2 is rotated in the arrow direction shown in FIG. 14 to deliver the printing paper 30 to the transport rollers 7 and 8. When the leading edge of the printing paper 30 is caught between the transport rollers 7 and 8, the thermal head 1 is turned upward, and the printing paper 30 is now carried and discharged only by the rotation of the transport rollers 7 and 8.

Figure 2:
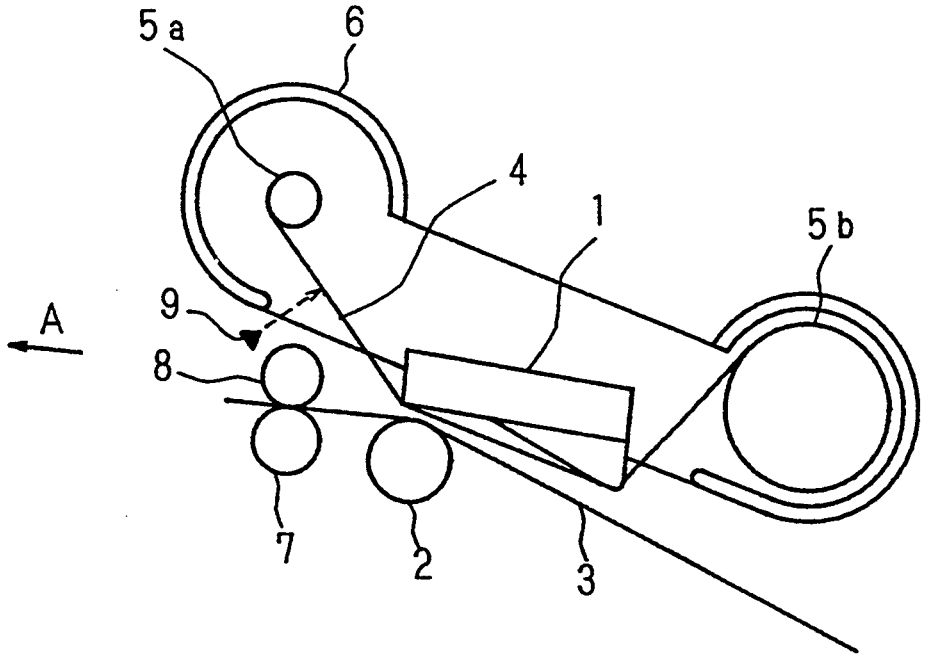
FIG. 2 PRIOR ART
FIG. 2 is a side view of another conventional sublimation type thermal transfer printer.
Figure 3:
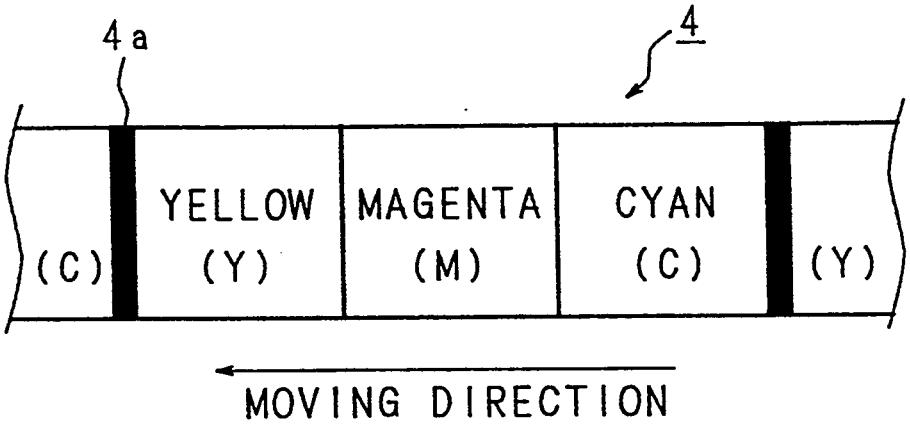
FIG. 3 PRIOR ART
FIG. 3 is a plan view of a conventional ink sheet.
Figure 4:
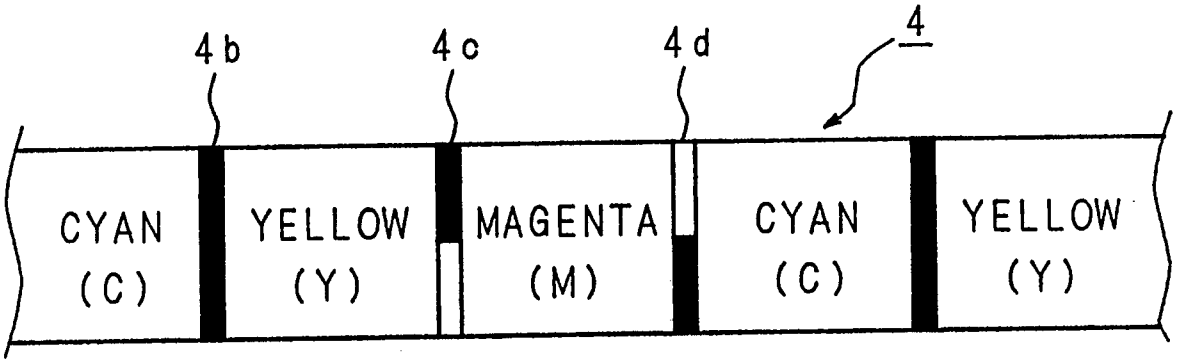
FIG. 4 PRIOR ART
FIG. 4 is a plan view of another conventional ink sheet.
Figure 5:
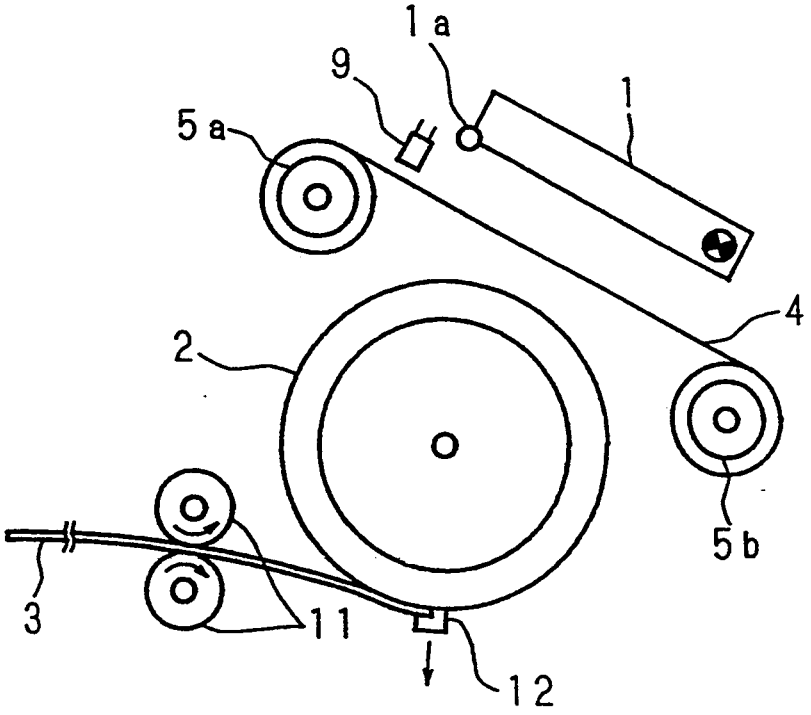
FIG. 5 PRIOR ART
FIG. 5 is a side view showing the conventional sublimation type thermal transfer printer of FIG. 1 in paper feeding.
Figure 6:
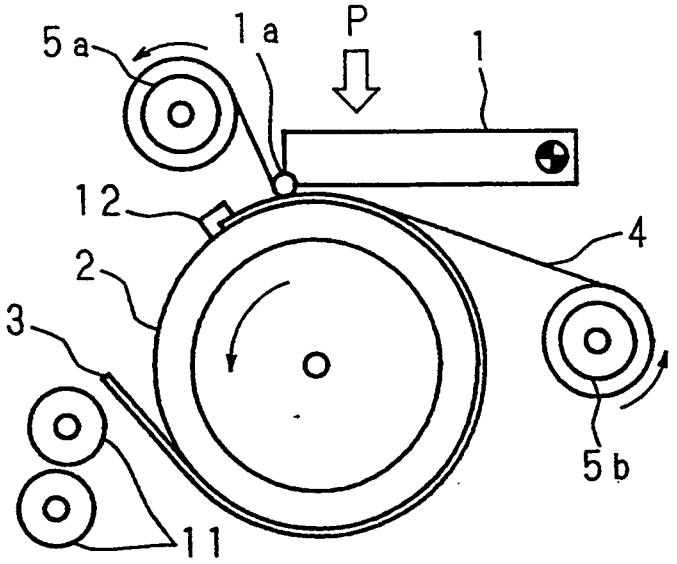
FIG. 6 PRIOR ART
FIG. 6 is a side view showing the conventional sublimation type thermal transfer printer of FIG. 1 in transfer printing.
Figure 7:
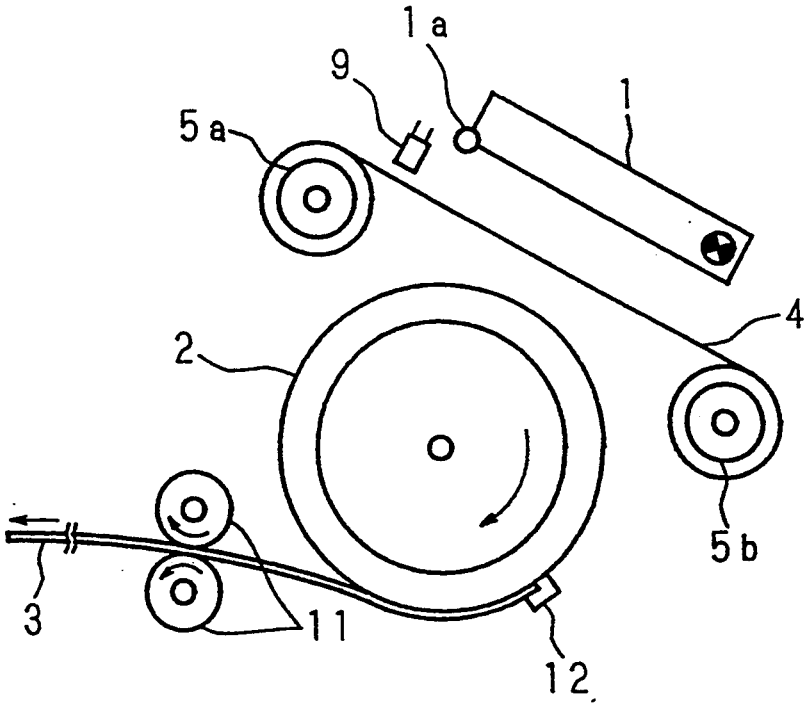
FIG. 7 PRIOR ART
FIG. 7 is a side view showing the conventional sublimation type thermal transfer printer of FIG. 1 in paper discharging.
Figure 8:
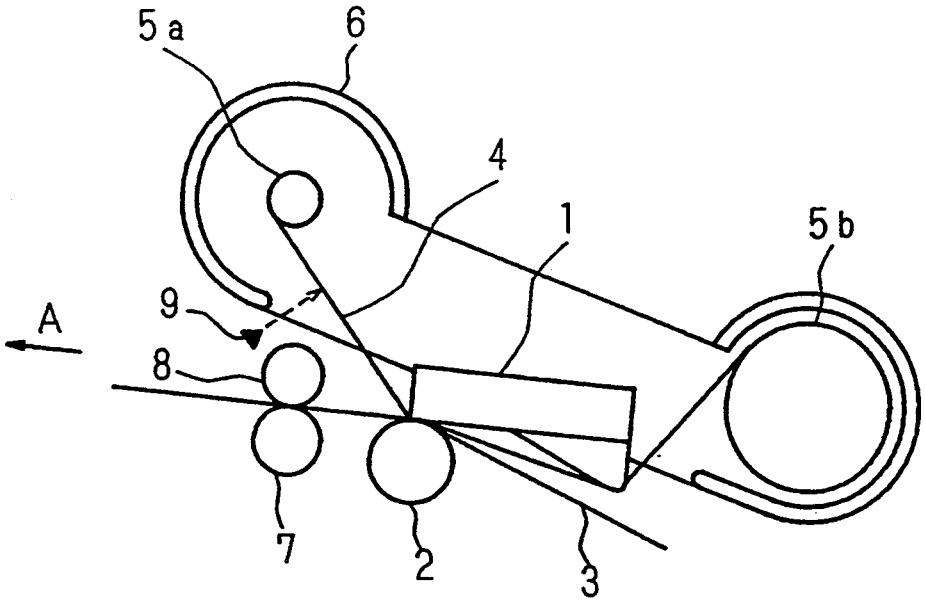
FIG. 8 PRIOR ART
FIG. 8 is a side view showing the other conventional sublimation type thermal transfer printer of FIG. 2 in transfer printing.
Figure 9:
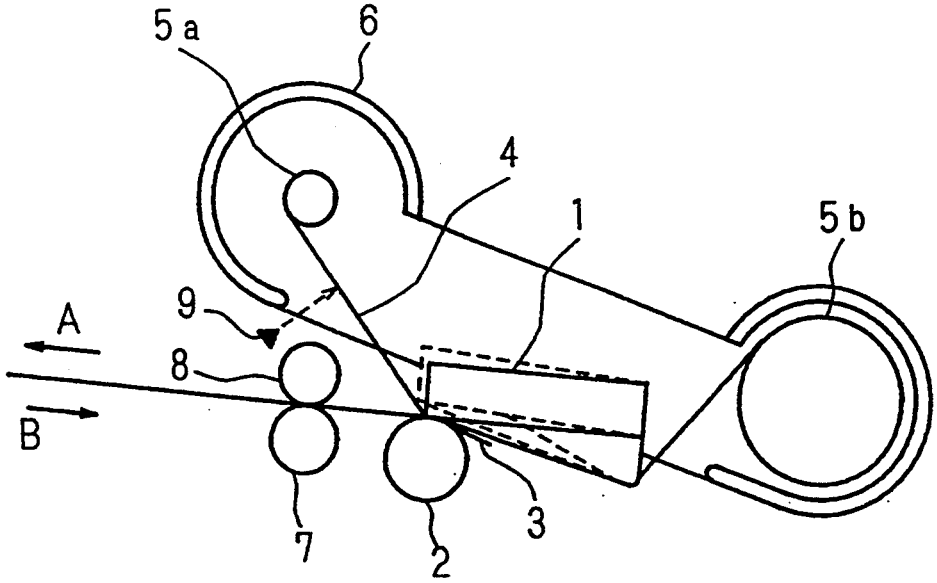
FIG. 9 PRIOR ART
FIG. 9 is a side view showing the other conventional sublimation type thermal transfer printer of FIG. 2 in ink color changing or paper discharging.
Figure 15:
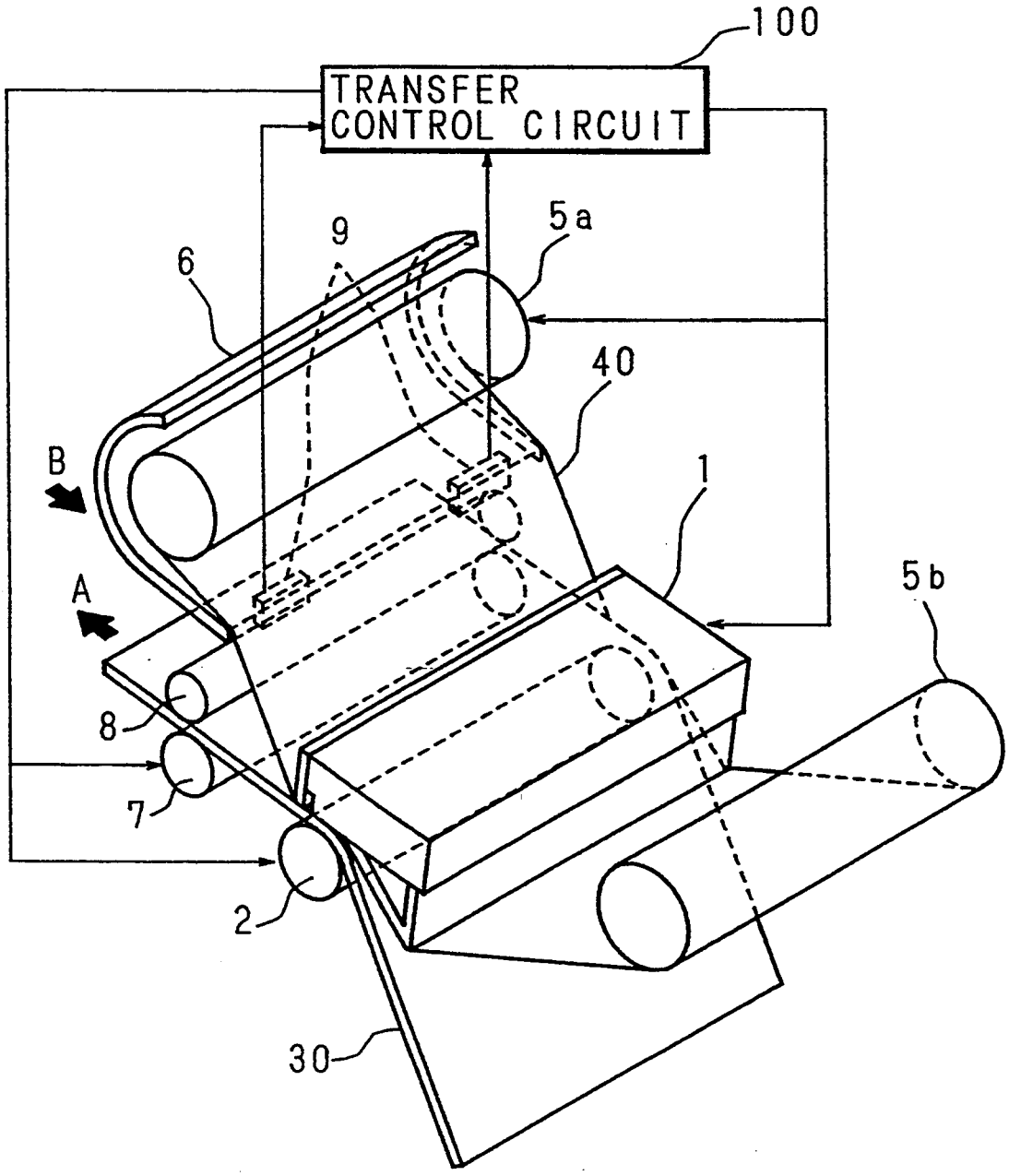
FIG. 15 is a perspective view of a sublimation type thermal transfer printer according to another embodiment of the invention.

FIG. 15 is a perspective view showing another embodiment of the sublimation type thermal transfer printer of the invention. The same or corresponding parts to the conventional printer of FIG. 2 and the first embodiment of the invention of FIG. 10 are designated by the same reference numerals, and explanatory description of such parts is omitted herein.

Figure 16:
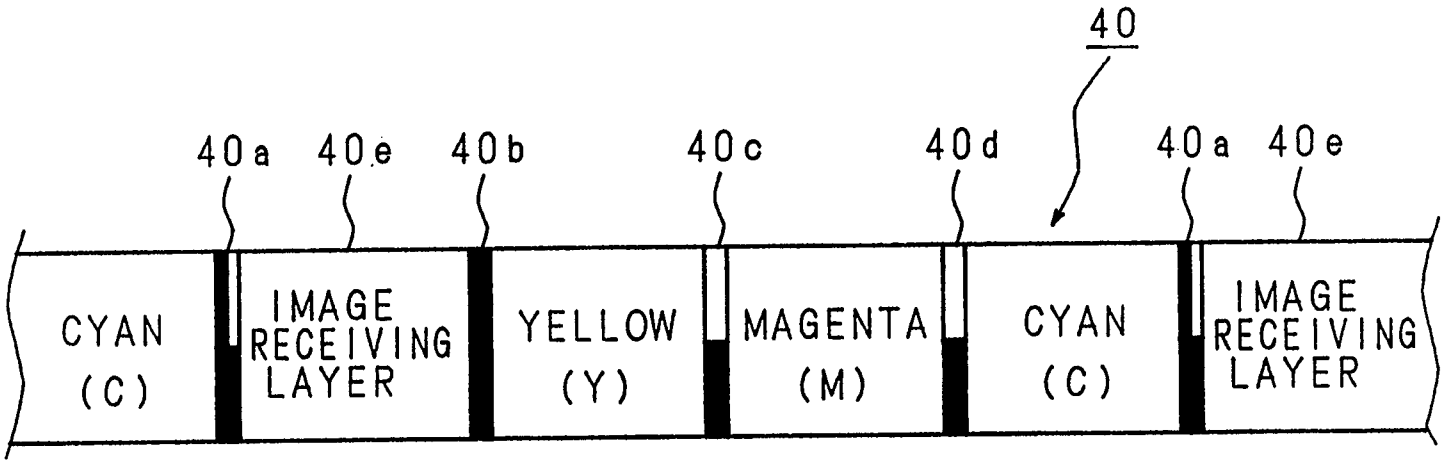
FIG. 16 is a plan view of an ink sheet according to another embodiment of the invention.

FIG. 16 is a plan view of an ink sheet according to another embodiment of the invention. The ink sheet of this embodiment differs from that of the foregoing embodiment in that a yellow area start mark 40*b*, a magenta area start mark 40*c*, and a cyan area start mark 40*d* are respectively provided at the beginning of the yellow, magenta, and cyan ink areas. The start mark 40*a* and the color area start marks 40*b*, 40*c* and 40*d* respectively have different light shielding patterns so that each area is identified by the amount of light incident on two photosensors 9 and 9.

Figure 17:
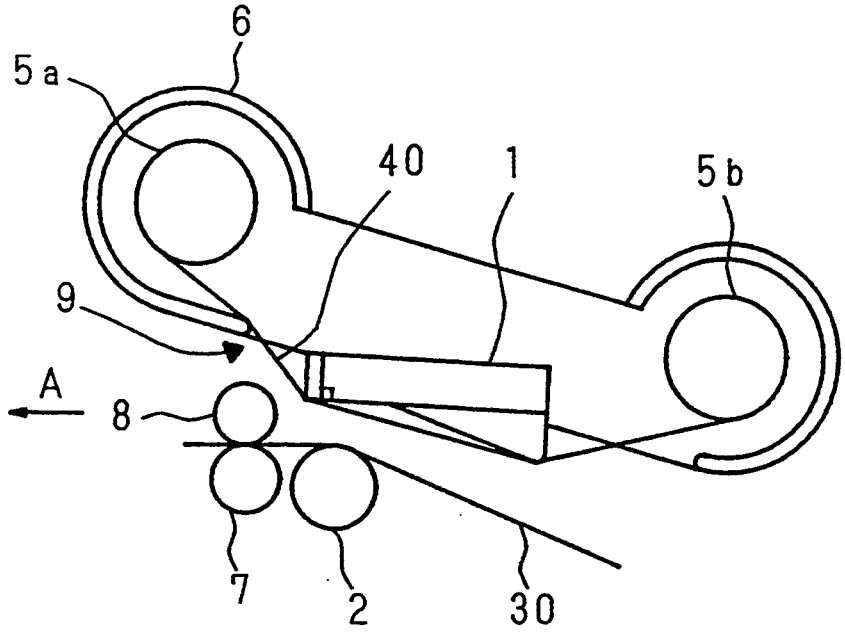
FIG. 17 is a side view showing the printer of FIG. 15 in paper feeding.
Figure 18:
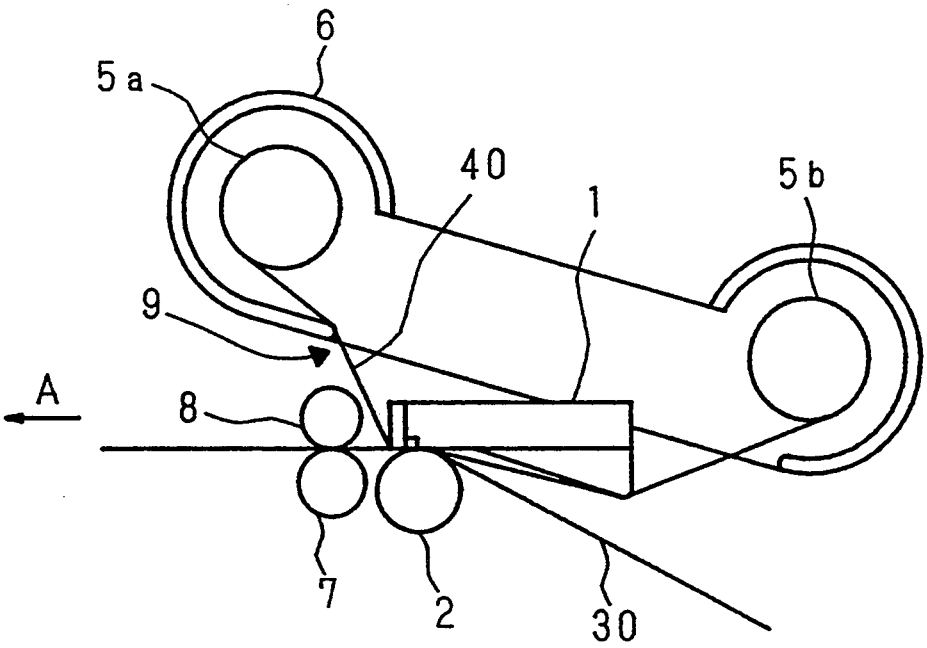
FIG. 18 is a side view showing the printer of FIG. 15 in transfer position changing and transfer printing.

Next, we will describe the operation of the printer of FIG. 15 in color printing on plain paper by using the ink sheet 40 of FIG. 16. FIGS. 17 and 18 are side views showing the printer in paper feeding and transfer printing operations, respectively, and FIG. 19 is a side view showing the printer in transfer area change or paper discharge operations.

With the thermal head 1 resting in standby position above the platen 2, the printing paper 30 is transported by means of the transport rollers 7 and 8 to the print start position shown in FIG. 17. At the same time, the takeup reel 5*a* is rotated to reel up and transport the ink sheet 40. When the light detection output from one of the photosensors 9, 9 reduces by half and that from the other photosensor reduces to zero, the start mark 40*a* at the beginning of the image receiving are 40*e*, i.e. the print start position of the ink sheet 40, is detected, upon which the rotation of the takeup reel 5*a* stops, thus readying the ink sheet 40 for printing.

Next, as shown in FIG. 18, the thermal head 1 is moved down toward the platen 2 to press the ink sheet 40 onto the printing paper 30 held on the surface of the platen 2. The printing paper 30 pressed between the transport rollers 7 and 8 is moved in the direction A. At the same time, the takeup reel 5*a* is rotated to move the ink sheet 40. While the printing paper 30 is being moved, prescribed electrical signals are applied to the thermal head 1 to heat the heating elements in the thermal head 1. The heat is conducted to the ink sheet 40, causing the fixing agent on the image receive coating area 40*e* of the ink sheet 40 to melt and be fused to the surface of the printing paper 30. During printing, the photosensors 9 and 9 continue to detect light, but their outputs are not detected.

Figure 19:
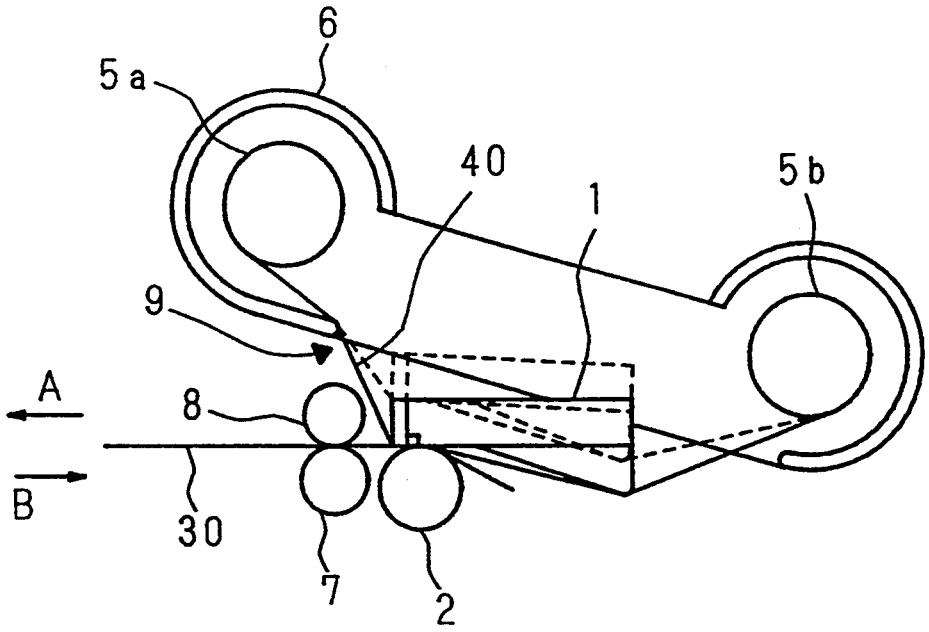
FIG. 19 is a side view showing the printer of FIG. 15 in paper discharging.

After the transfer of the image receiving coating 40*e* is completed, the thermal head 1 is moved upward away from the platen 2 as shown by dotted lines in FIG. 19. The takeup reel 5*a* is rotated to advance the ink sheet 40. When the detection outputs from both the photosensors 9 and 9 reduce to zero, the next start mark 40*b* at the beginning of the yellow ink is detected, upon which the feeding of the ink sheet 40 is stopped. The capstan roller 7 is now rotated in the direction opposite to the direction in printing, to feed the printing paper 30 backward in the direction B, thus repositioning the printing paper 30 at the print start position shown in FIG. 17.

Next, as shown in FIG. 18, the thermal head 1 is lowered toward the platen 2 to press the ink sheet 40 onto the printing paper 30 held on the surface of the platen 2. The printing paper 30 pressed between the transport rollers 7 and 8 is moved in the direction A. At the same time, the takeup reel 5*a* is rotated to move the ink sheet 40. While the printing paper 30 is being moved, prescribed electrical signals are applied to the thermal head 1 to selectively heat the heating elements in the thermal head 1. The heat is conducted to the ink sheet 40 to cause the yellow ink on the ink sheet 40 to sublime and be fused onto the image receiving layer transferred on the surface of the printing paper 30.

When the printing with the yellow ink is completed, the thermal head 1 is moved upward away from the platen 2, as at the end of the transfer of the fixing agent on the image receive coating area 40*e*. The takeup reel 5*a* is rotated to advance the ink sheet 40. When the detection output from one of the photosensors 9, 9 reduce to zero, the next start mark 40*c* at the beginning of the magenta ink is detected, upon which the feeding of the ink sheet 40 is stopped. The printing paper 30 is then moved backward in the direction B and repositioned at the print start position, after which printing with the magenta ink is performed in the same manner as in the printing with the yellow ink.

When the printing with the magenta ink is completed, the thermal head 1 is moved upward away from the platen 2, as at the end of the transfer of the yellow ink. The takeup reel 5*a* is rotated to advance the ink sheet 40. When the detection output from the other photosensor 9 reduce to zero, the next start mark 40*d* at the beginning of the cyan ink is detected, upon which the feeding of the ink sheet 40 is stopped. The printing paper 30 is then moved backward in the direction B and repositioned at the print start position, after which printing with the cyan ink is performed in the same manner as in the printing with the yellow and magenta inks.

In this manner, the three color inks of yellow, magenta and cyan are thermally sublimed and transferred one on another onto the printing paper 30 to produce a color image thereon.

At the end of the transfer printing process, the takeup reel 5*a* is slightly rotated to move the ink sheet 40 by a short distance in order to take in the slack of the ink sheet 40 caused by the upward movement of the thermal head 1. Next, the capstan roller 7 is rotated in the same direction as in printing, so that the transport rollers 7 and 8 transport the printing paper 30 further in the direction A for discharging outside the printer.

Figure 20:
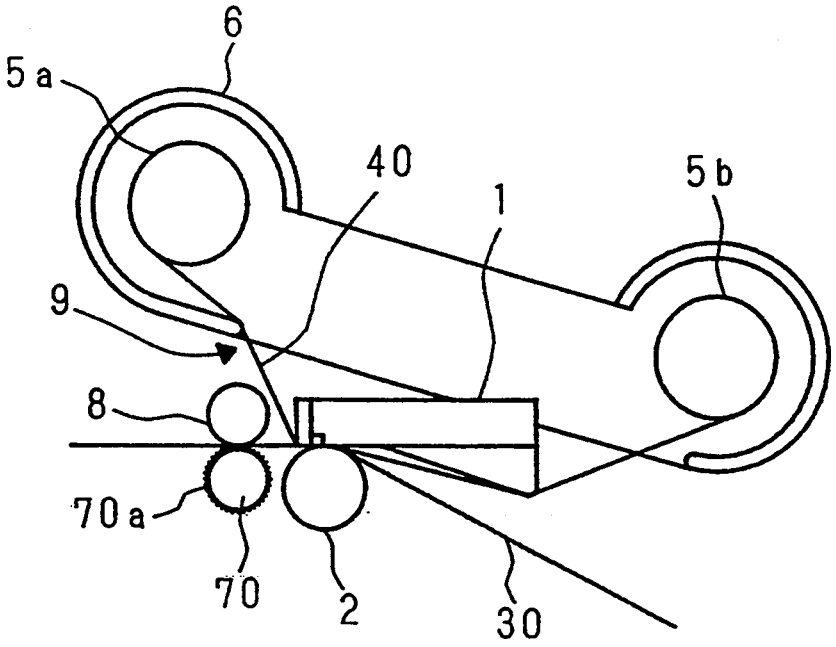
FIG. 20 is a side view of a sublimation type thermal transfer printer according to a further embodiment of the invention.

FIG. 20 is a side view of a further embodiment of the sublimation type thermal transfer printer of the invention. The same or corresponding parts to those of the foregoing printer are designated by the same reference numerals, and explanatory description of such parts is omitted herein.

The printing operation is the same as that of the foregoing printer.

This embodiment is characterized by the provision of protrusions 70*a* formed in rows on the surface of the capstan roller 70. The printing paper 30(3) is transported on the capstan roller 70 with the protrusions 70*a* gripping the printing paper 30(3).

Figure 21:
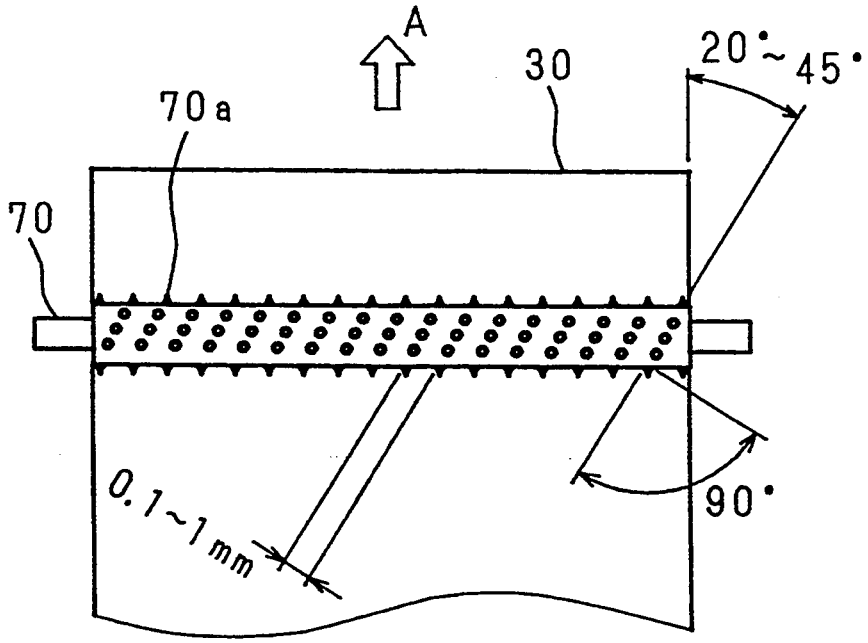
FIG. 21 is a bottom view of an example of a capstan roller used in the printer of FIG. 20.

FIG. 21 is a bottom view of the capstan roller 70. As shown, the protrusions 70*a* in each row are formed at equally spaced intervals, and the rows are orderly arranged at an angle of 20° to 45° relative to the transport direction A of the printing paper 30 and at a regular interval of 0.1 to 1.0 mm measured in the direction perpendicular to the transport direction A.

Furthermore, the protrusions 70*a* in each row are arranged so as not to align with the protrusions 70*a* in other rows in directions at 45° or 90° from the transport direction A. This is because, if the protrusions 70*a* in different rows are so arranged as to align in the directions at 45° or 90° from the transport direction A, at some positions of rotation the protrusions in all rows are aligned along the axial direction of the capstan roller 70 to grip the printing paper 30(3) while at another position of rotation there are no protrusions to grip the printing paper 30(3) along that direction. That is, at positions of rotation where no protrusions exist, since there are no protrusions to grip the printing paper 30(3), the transportation of the printing paper 30(3) may not be controlled precisely. To prevent this, the protrusions 70*a* in each row are arranged so as not to align with the protrusions 70*a* in other rows in directions at 45° or 90° from the transport direction A so that the protrusions 70*a* will appear along the axial direction of the capstan roller 70 at any position of rotation. This arrangement ensures precise control of the transportation of the printing paper 30(3) with the protrusions 70*a* gripping the printing paper 30(3).

In this manner, the printing paper 30(3) on the transport rollers 70 and 8 is prevented from slipping, and the transport force of the transport rollers 70 and 8 increases, thus preventing the printing paper transport accuracy from being lowered by disturbance. Furthermore, with the capstan roller 70 of the above construction, various types of printing paper having different surface friction coefficients can be transported.

Since the capstan roller 70 contacts the opposite side of the printing paper 3 to the printed side thereof, the protrusions 70*a* scarcely damage the printed side.

Figure 22:
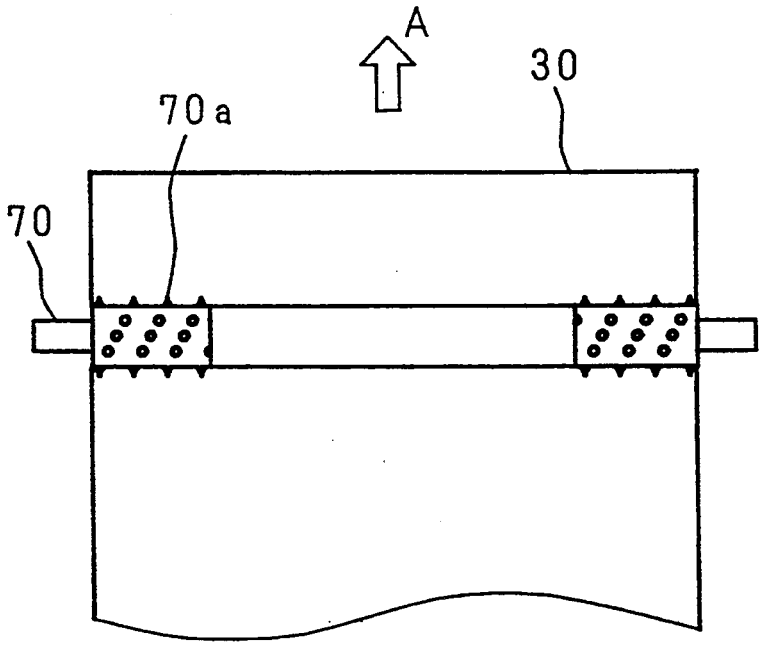
FIG. 22 is a bottom view of another example of a capstan roller used in the printer of FIG. 20.

FIG. 22 is a bottom view of the capstan roller 70 in another embodiment.

In this embodiment, the protrusions 70*a* on the middle axial part of the capstan roller 70 are omitted, but protrusions 70*a* are provided only on the circumferential surface at each axial end of the capstan rollers 70. The capstan roller 70 of this embodiment is therefore easier and less expensive to construct.

The capstan roller 70 transports the printing paper 30(3) in reliable manner with the protrusions 70*a* on both end portions gripping the edges of the printing paper 30(3).

In the printer of any of the above embodiments, the ink sheet 40 may be replaced by the ink sheet 4 which is only coated with yellow, magenta and cyan color ink, and the special printing paper 3 coated with a sublimation ink fixing layer may be used instead of the plain printing paper 30. In that case, the paper feed and discharge operations are the same as when using the plain paper, but in full color printing, the yellow, magenta and cyan inks are transferred, one on another, directly onto the printing paper 3 held on the surface of the platen 2.

As for the ink sheet 40 having the image receive coating area, either the type of ink sheet only containing the start mark 40*a* or the type of ink sheet containing the color start marks 40*b*, 40*c* and 40*d* in addition to the start mark 40*a* may be used.

Figure 23:
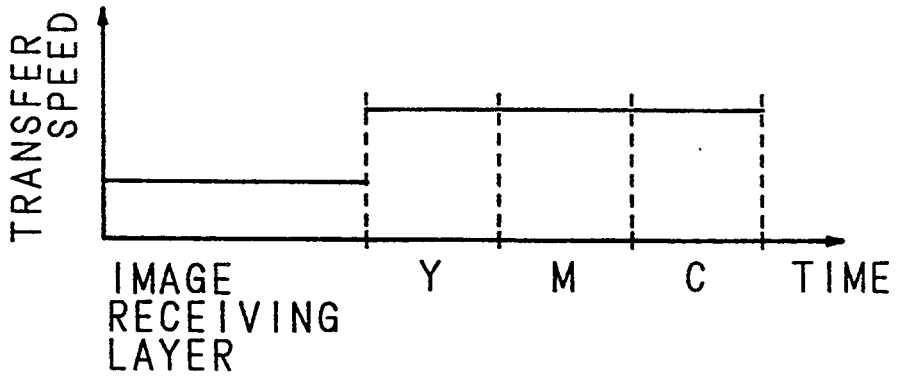
FIG. 23 is a diagram showing the relationship between transfer speed and transfer time in the printer of the invention.
Figure 24:
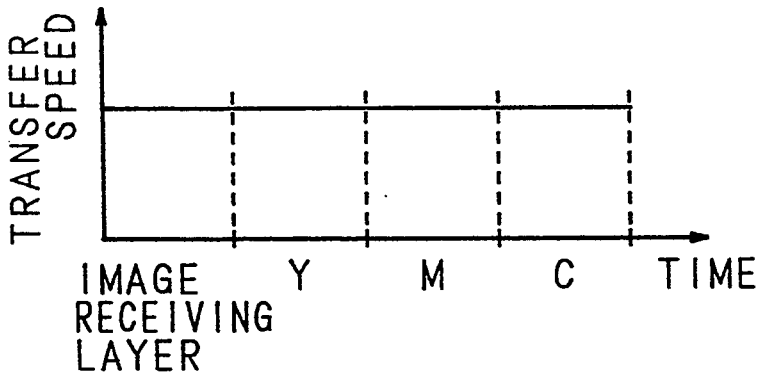
FIG. 24 is a diagram showing the relationship between transfer speed and transfer time in the printer of the invention.
Figure 25:
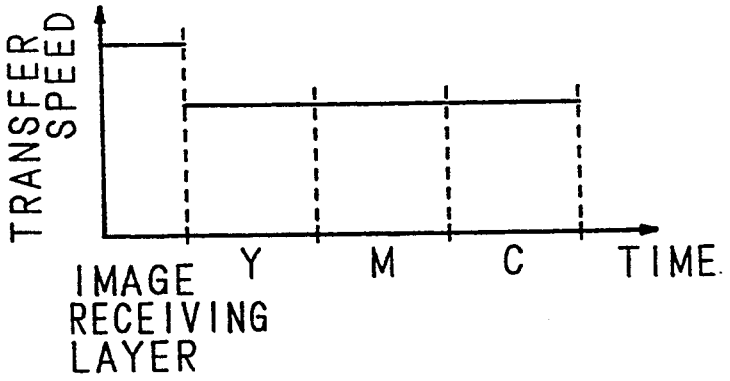
FIG. 25 is a diagram showing the relationship between transfer speed and transfer time in the printer of the invention.

FIGS. 23, 24, and 25 are diagrams showing the transfer speeds (which depend on the moving speeds of the ink sheet 40 and the printing paper 30) of the image receive coating area 40*e* and the color ink areas of yellow (Y), magenta (M) and cyan (C), plotted against the transfer time when the ink sheet 40 having the image receive coating area is used for transfer printing.

When the power supply used for transfer printing does not have a sufficient capacity for high-speed printing at full power, the transfer time for the image receive coating area 40*e* may be made longer than that for each of the yellow, magenta and cyan ink areas, as shown in FIG. 23, thus reducing the transfer speed of the image receive coating area 40*e* as compared with that for each of the yellow, magenta and cyan ink area. This serves to reduce the load on the power supply, allowing the use of the same small power supply as used in the conventional printer.

On the other hand, if the transfer speed of the image receive coating area 40*e* is made equal to that of each of the yellow, magenta and cyan ink areas, as shown in FIG. 24, the same transfer control sequence as in the prior art can be used since there is no need to change the transfer time between the image receive coating area 40*e* and the yellow, magenta, and cyan ink areas.

When the power supply used for transfer printing has a sufficient capacity to allow high-speed printing at full power, the transfer speed of the image receive coating area 40*e* may be made faster than that of each of the yellow, magenta and cyan ink areas, as shown in FIG. 25, and the transfer time for the image receive coating area 40*e* becomes shorter than that for each of the yellow, magenta and cyan ink areas, so that the total printing time does not increase appreciably despite the additional step required to transfer the image receive coating area 40*e*.

Figure 26:
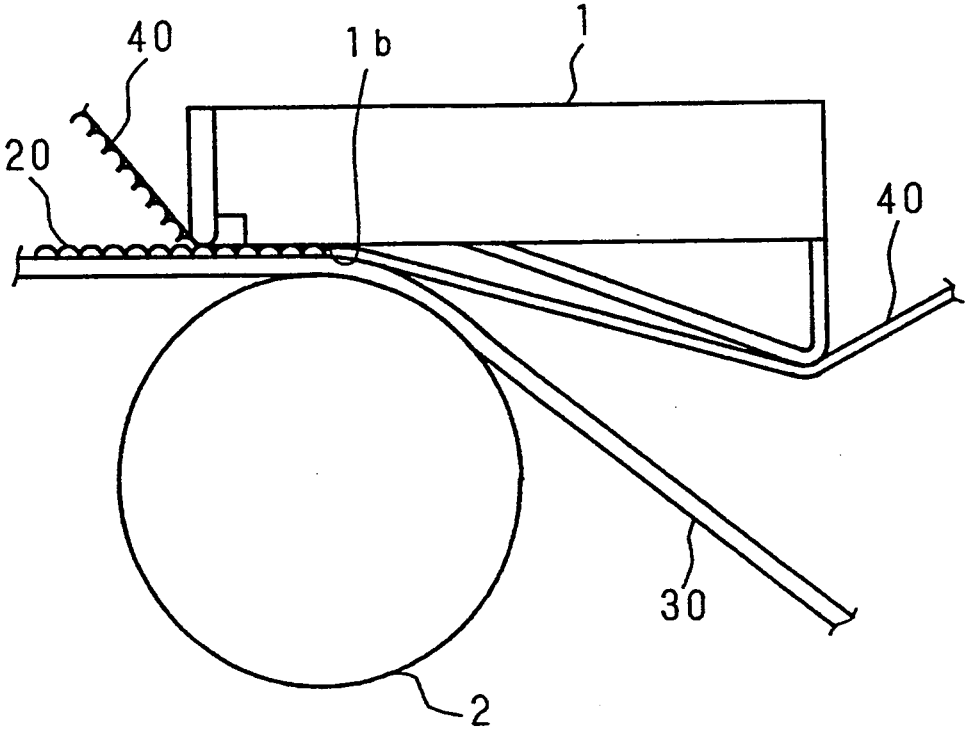
FIG. 26 is a schematic diagram showing the relationship between the heating cycle and the number of times of heating of the thermal head employed in the printer of the invention.
Figure 27:
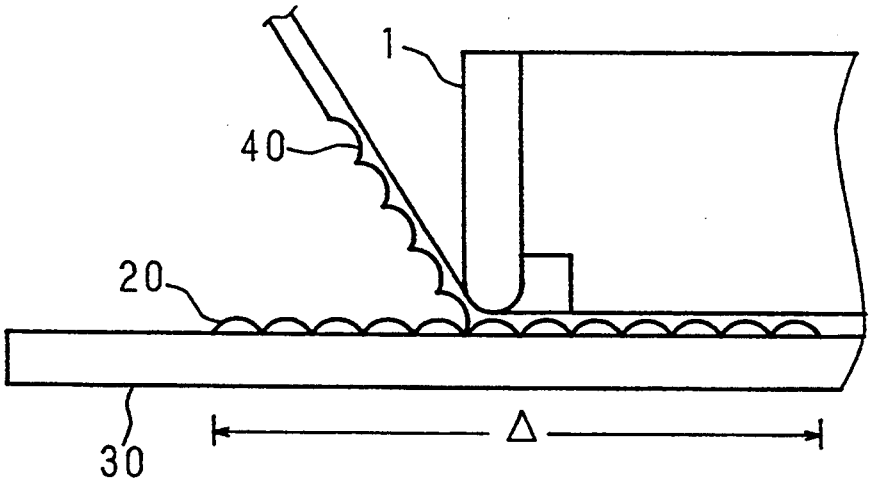
FIG. 27 is a schematic diagram showing the relationship between the heating cycle and the number of times of heating of the thermal head employed in the printer of the invention.
Figure 28:
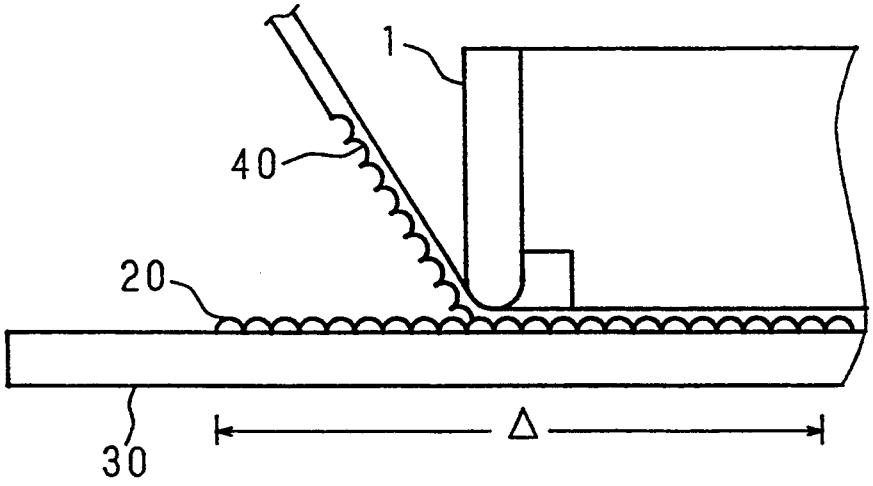
FIG. 28 is a schematic diagram showing the relationship between the heating cycle and the number of times of heating of the thermal head employed in the printer of the invention.

FIG. 26 is a side view showing the printer in transferring the fixing agent on the image receive coating area 40*e* to the printing paper 30. FIGS. 27 and 28 are side views showing the thermal head 1 and its vicinity. In the figures, the reference numeral 1*b* shows the heating part of the thermal head 1, and the numeral 20 indicates the image receiving layer transferred to the printing paper 30. Semicircles of the image receiving layer 20 on the printing paper 30 show each heating cycle and the numbers of times of heating by the thermal head 1.

When the yellow, magenta, and cyan inks are transferred with the heating cycle and the number of times of heating shown in FIG. 27, and when, as shown in FIG. 28, the image receive coating area 40*e* is transferred with a shorter heating cycle and a greater number of times of the heating than those of FIG. 27, the image receive coating area 40*e* for fixing the color inks is transferred uniformly with fine texture, thus enhancing print quality.

The light shielding portions of the start mark 40*a* and the color ink start marks 40*d*, 40*c* and 40*d* on the ink sheet may be coated with a black ink, but if these marks are coated with the same material as that of the image receive coating area 40*e*, a material that shields light as the black ink, the production cost of the ink sheet, and hence the print cost, can be reduced since one processing step can be eliminated from the ink sheet fabrication process.

Figure 30:
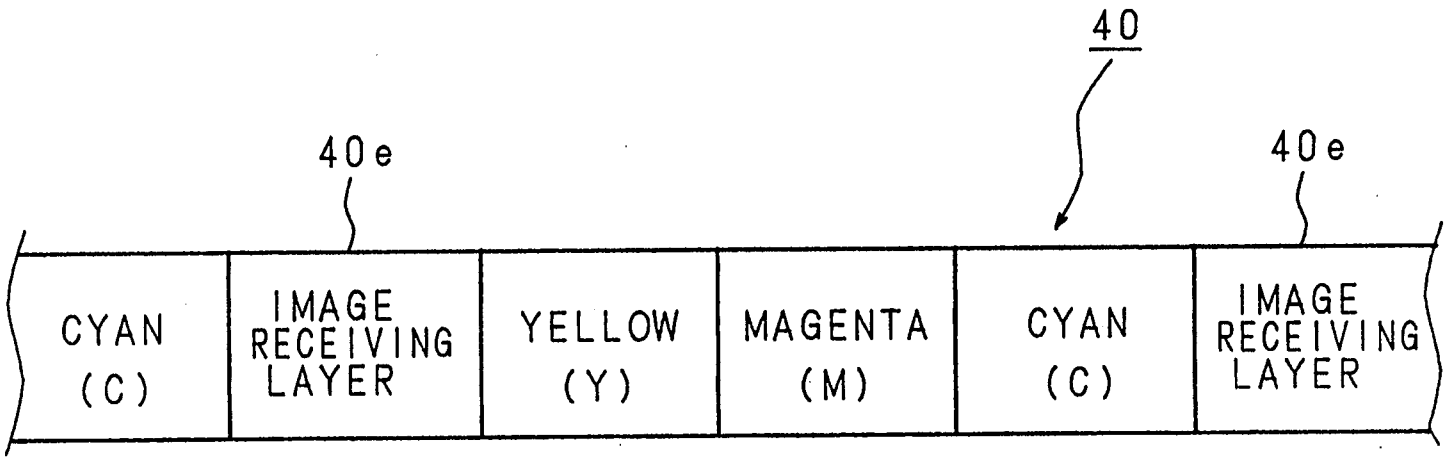
FIG. 30 is a plan view of an ink sheet according to further another embodiment of the invention.

Additionally, as shown in FIG. 30, an ink sheet without special start marks may be employed, and in such case the start point of the image receiving layer itself functions as the start of printing.

Furthermore, if the surface rubber of the platen 2 is chosen to have a hardness of 30° to 60° in type A hardness prescribed by JIS K6301-1975, and if the force to press the thermal head 1 on the platen 2 is set within the range of 2.5 to 3.5 kilograms, the contact between the thermal head 1 and the printing paper 30(3) with the ink sheet 40(4) sandwiched therebetween is maintained in a desirable condition and a stable pressing force can be obtained, thus ensuring the production of an evenly formed, fine image with uniform density and no blurs image.

Figure 29:
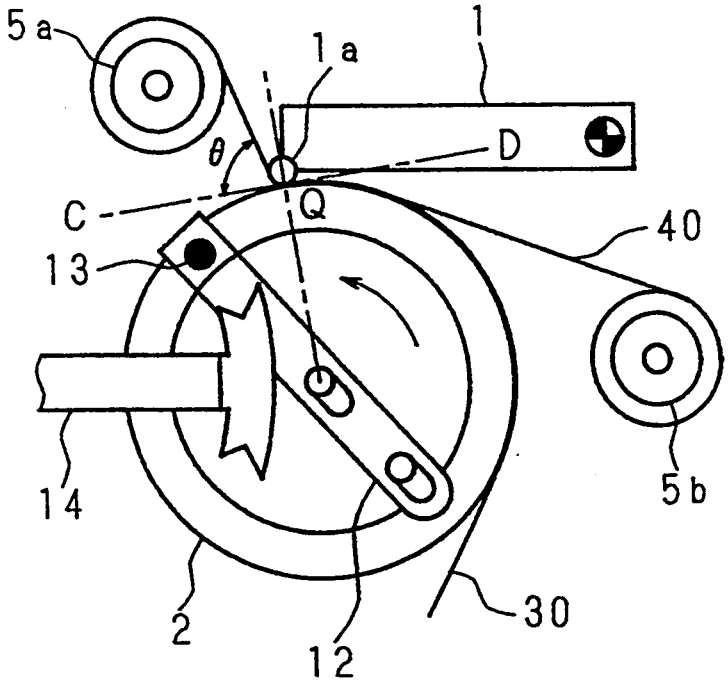
FIG. 29 is a diagram showing the separation angle of the ink sheet to the printing paper in the sublimation type thermal transfer printer of the invention.

FIG. 29 is a diagram explaining the separation angle of the ink sheet 40(4) from the printing paper 30(3). When the angle that the ink coated surface of the ink sheet 40(4) makes with the tangent CD of the platen 2 at point Q where the ink sheet 40(4) separates from the printing paper 30(3) after transfer, is denoted as the separation angle $\theta$, the thermal head 1, the takeup reel 5*a* and the platen 2 are desired to be disposed in such positions that the separation angle $\theta$ comes within the range of 80° to 110°. With this setting, the ink sheet 40(4) separates smoothly without getting tangled and is less susceptible of wrinkling, thus ensuring production of an image of good quality without wrinkles on the printed surface of the printing paper 30(3).

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within mates and bounds of the claims, or equivalence of such metes and bounds thereof are therefore intended to be embraced by the claims.

What is claimed is:

1. A sublime type transfer printer comprising:

an ink sheet having an image receive coating area coated with a fixing agent of a sublimation ink and an ink area coated with the sublimation ink wherein the image receive coating area and the ink area are alternatively formed a plurality of times;

a pair of reels for transporting sequentially the image receive coating area and then the ink area of the ink sheet to a transfer position;

a pair of rollers for transporting a printing paper, onto which an image is to be transferred, to the transfer position by holding the printing paper therebetween, the printing paper having first and second opposed sides;

a platen having a surface for holding the printing paper thereon;

a thermal head for thermally transferring an image by pressing the ink sheet onto the printing paper held on the platen; and a transfer control circuit for controlling transferring of the fixing agent on the image receive coating area of the ink sheet onto a fixing agent transferred area of the printing paper and then transferring the image onto the fixing agent transferred area of the printing paper by subliming the ink of the ink area, wherein the transfer control circuit individually controls a transfer speed and a transfer time of the fixing agent on the image receive coating area and a transfer speed and a transfer time of the sublimation ink on the ink area, respectively.

2. The sublime type thermal transfer printer as set forth in claim 1, wherein the transfer control circuit controls a transfer speed and a transfer time of the fixing agent on the image receive coating area to be equal to a transfer speed and a transfer time of the sublimation ink on the ink area, respectively.

3. The sublime type thermal transfer printer as set forth in claim 1, wherein the transfer control circuit controls a transfer speed faster and a transfer time shorter of the fixing agent on the image receive coating area than a transfer speed and a transfer time of the sublimation ink on the ink area, respectively.

4. The sublime type thermal transfer printer as set forth in claim 1, wherein the transfer control circuit controls a transfer speed slower and a transfer time longer of the fixing agent on the image receive coating area than a transfer speed and a transfer time of the sublimation ink on the ink area, respectively.

5. The sublime type thermal transfer printer as set forth in claim 1, wherein the transfer control circuit controls a heating cycle and a number of times of heating by the thermal head in transfer of the fixing agent on the image receive coating area to be equal to a heating cycle and a number of times of heating by the thermal head in the sublimation of the ink on the ink area, respectively.

6. The sublime type thermal transfer printer as set forth in claim 1, wherein the transfer control circuit controls a heating cycle shorter and a number of times of heating greater by the thermal head in transfer of the fixing agent on the image receive coating area than a heating cycle and a number of times of heating by the thermal head in the sublimation of the ink on the ink area, respectively.

7. The sublime type thermal transfer printer as set forth in claim 1, wherein one of the pair of the rollers for transporting the printing paper to the transfer position, which contacts the second side of the printing paper includes a circumferential surface, a section of the circumferential surface being provided with a plurality of rows of protrusions.

8. The sublime type thermal transfer printer as set forth in claim 7, wherein each of said rows of protrusions is formed at an angle of 20° to 45° from a transporting direction of the printing paper.

9. The sublime type thermal transfer printer as set forth in claim 7, wherein adjacent rows of said rows of protrusions are spaced 0.1 to 1.0 mm in a direction perpendicular to a transporting direction of the printing paper.

10. The sublime type thermal transfer printer as set forth in claim 7, wherein the protrusions in different rows are so arranged as not to align with each other in a direction at angle of 45° or 90° from a transporting direction of the printing paper.

11. The sublime type thermal transfer printer as set forth in claim 7, wherein the the section is the entire circumferential surface of the roller.

12. The sublime type thermal transfer printer as set forth in claim 7, wherein the section of the circumferential surface has a pair of end portions and the protrusions are formed over the circumferential surface at each said end portion of the roller.

13. The sublime type thermal printer as set forth in claim 1, wherein the the platen has a surface rubber having a hardness within a range of 30° to 60° in A-type hardness prescribed by JIS K6301-1975.

14. The sublime type thermal transfer printer as set forth in claim 1, wherein the thermal head presses against the platen with a pressure set within a range of 2.5 to 3.5 kilograms.

15. The sublime type thermal transfer printer as set forth in claim 1, further comprising a pair of ink sheet transporting rollers, wherein said pair of ink sheet transporting rollers, the thermal head, and the platen are so disposed in positions that an angle between the surface of the ink sheet and a tangent of a circumference of the platen at a point where the ink sheet is pressed by the thermal head onto the printing paper on the platen separates from the paper after transferring, is within a range of 80° to 110°.

16. An ink sheet comprising:

an image receive coating area coated with a fixing agent of a sublimation ink and having a mark indicating a start of the image receive coating area;

a coating material; and an ink area coated with the sublimation ink;

wherein the image receive coating area and the ink area are alternatively formed a plurality of times and the coating material is disposed on the mark indicating the start of the image receive coating area and on the image receive coating area.

17. The ink sheet as set forth in claim 16, further comprising a mark indicating a start of the image receive coating area and a mark indicating a start of the ink area.

18. The ink sheet as set forth in claim 17, further comprising a coating material, the coating material coating the marks indicating the start of the image receive coating area and the start of the ink area.

19. The ink sheet as set forth in claim 16, wherein a start of said image receive coating area functions as a start of printing.

20. A thermal transfer printer for printing an image on a receiving medium comprising:

an ink sheet having an image receive coating area coated with a fixing agent of a sublimation ink and an ink area coated with the sublimation ink wherein the image receive coating area and the ink area are alternatively formed a plurality of times;

a thermal head for thermally transferring an image by pressing the ink sheet onto the receiving medium held on a platen and a transfer mechanism for translating said ink sheet and the receiving medium across said thermal head;

a transfer control circuit for controlling transferring of the fixing agent on the image receive coating area of said ink sheet onto a fixing agent transferred area of the receiving medium and then transferring the image onto the fixing agent transferred area of the receiving medium by subliming the ink of the ink area, wherein the transfer control circuit individually controls a transfer speed and a transfer time of the fixing agent on the image receive coating area and a transfer speed and a transfer time of the sublimation ink on the ink area, respectively.

21. The printer as set forth in claim 20, wherein the transfer control circuit controls the transfer speed and the transfer time of the fixing agent on the image receive coating area to be different from the transfer speed and the transfer time of the sublimation ink on the ink area, respectively.

* * * * *